US005300725A

United States Patent [19]

Manabe

[11] Patent Number: 5,300,725

[45] Date of Patent: Apr. 5, 1994

[54] AUTOMATIC PLAYING APPARATUS

[75] Inventor: Hajime Manabe, Higashiyamato, Japan

[73] Assignee: Casio Computer Co., Ltd., Tokyo, Japan

[21] Appl. No.: 976,411

[22] Filed: Nov. 13, 1992

[30] Foreign Application Priority Data

Nov. 21, 1991 [JP] Japan ..... 3-306228

[51] Int. Cl.[5] ..... G10H 1/00

[52] U.S. Cl. ..... 84/609; 84/645

[58] Field of Search ..... 84/609–614, 84/645

[56] References Cited

U.S. PATENT DOCUMENTS 4,945,805 8/1990 Hour ..... 84/610
5,138,925 8/1992 Koguchi et al. .
5,148,419 9/1992 Koguchi .
5,243,123 9/1993 Chaya ..... 84/609

*Primary Examiner*—Stanley J. Witkowski
*Attorney, Agent, or Firm*—Frishauf, Holtz, Goodman & Woodward

[57] ABSTRACT

An automatic playing apparatus is provided which is capable of executing an automatic performance using a complex combination of audio data and sequence data. In the apparatus, a buffer is provided between the hard disk and audio input/output devices and MIDI input-/output device, and serves to temporality record and-/or reproduce data to or from the hard disk. Event data of the hard disk are selectively read out to the buffer under control of the CPU, and the event data are further transferred to the audio input/output devices and the MIDI input/output device, for executing automatic performance based on audio data and MIDI data.

9 Claims, 16 Drawing Sheets

| EVENT NO. | RELATIVE ADDRESS DATA (START) | RELATIVE ADDRESS DATA (END) | |
|---|---|---|---|
| 1 | Ad0001 | Ad0002 | ADDRESS OF MIDI DATA |
| 2 | Ad0003 | Ad0004 | |
| 3 | Ad0005 | Ad0006 | |
| 4 | Ad0007 | Ad0008 | |
| 5 | Ad0009 | Ad0010 | |
| 6 | Ad0011 | Ad0012 | |
| ⋮ | ⋮ | ⋮ | |
| 10 | Ad0019 | Ad0020 | ADDRESS OF AUDIO DATA |
| 11 | Ad0021 | Ad0022 | |
| 12 | Ad0023 | Ad0024 | |
| ⋮ | ⋮ | ⋮ | |
| 20 | Ad0039 | Ad0040 | |
| 21 | Ad0041 | Ad0042 | |
| ⋮ | ⋮ | ⋮ | |

FIG.5

| MIDI Tr | | AUDIO Tr1 | | AUDIO Tr2 | |
|---|---|---|---|---|---|
| H/M/S/SAMPLE | EVENTS | H/M/S/SAMPLE | EVENTS | H/M/S/SAMPLE | EVENTS |
| 00:00:00"00000 | 1 | 00:00:00"00000 | 10 | 00:00:00"00000 | 11 |
| 00:00:40"00000 | 2 | 00:01:00"00000 | 12 | 00:01:00"00000 | 13 |
| 00:01:00"00000 | 1 | 00:01:20"00000 | 20 | 00:01:20"00000 | 21 |
| 00:01:40"00000 | 3 | 00:02:00"00000 | 25 | 00:02:00"00000 | 26 |
| 00:02:25"00000 | 8 | | ⋮ | | ⋮ |
| | ⋮ | | | | |

FIG.7

AUTOMATIC PLAYING APPARATUS

BACKGROUND OF THE INVENTION

1. Field of the Invention

The present invention relates to an automatic playing apparatus which performs an automatic performance of a musical piece in accordance with audio data and sequence data.

2. Description of the Related Art

Automatic playing apparatus such as electronic musical instruments and personal computers with functions of automatically playing a musical piece have been developed. In these automatic playing apparatus, sequence data (a series of data which are representative of tone pitches and tone lengths of individual musical notes) which represent a musical piece are retained, and are read out to drive a sound source circuit for an automatic performance of the musical piece.

In recent, some other apparatus have been developed which are capable of reproducing a compact disk (CD) in synchronism with execution of the automatic performance.

The following patents and patent applications, for example, disclose apparatus which are capable of reproducing audio data in synchronism with reproduction of a series of musical-note data (typically, MIDI data):

U.S. Pat. No. 5,138,925 issued Aug. 18, 1992, Inventors: Satoru KOGUCHI, Yoshiyuki MURATA, U.S. Pat. No. 5,148,419 issued Sep. 15, 1992, Inventor: Satoru KOGUCHI, U.S. Ser. No. 07/625,309 filed Dec. 10, 1990, Inventor: Satoru KOGUCHI and now U.S. Pat. No. 5,189,237, U.S. Ser. No. 07,871,241 filed Apr. 20, 1992, Inventors: Nobuo IIZUKA, Hajime MANABE, U.S. Ser. No. 07/894,847 filed Jun. 5, 1992, Inventor: Satoru KOGUCHI, and U.S. Ser. No. 07/926,179 filed Aug. 8, 1992, Inventor: Satoru KOGUCHI.

The automatic playing apparatus which have been proposed, however, execute nothing more than starting reproduction of audio data and sequence data in synchronism with each other, and can not combine these two data in various manners to reproduce one musical piece while performing a playing operation.

SUMMARY OF THE INVENTION

The present invention has been made to improve these functions of the conventional automatic playing apparatus, and has an object to provide an automatic playing apparatus which is capable of executing a performance of a musical piece by combining reproduction of audio data and a performance based on sequence data in various manners during the performance of the musical piece.

According to one aspect of the present invention, there is provided an automatic playing apparatus, which comprises:

audio data storing means for storing audio data;

sequence data storing means for storing sequence data;

schedule table storing means for storing a schedule table which defines a schedule for reproduction of the audio data stored in said audio data storing means and the sequence data stored in said sequence data storing means;

reading means for reading out the audio data from said audio data storing means and the sequence data from said sequence data storing means in accordance with the schedule table stored in said schedule table storing means;

converting means for converting the audio data read out by said reading means into an audio signal; and musical tone generating means for generating corresponding musical tones in accordance with the sequence data read out by said reading means.

Various types of memory mediums can be employed as the above audio data storing means and the sequence data storing means, but a random access type of memory medium such as a hard disk, a magneto-optical disk and optical disk are most preferably used.

An example of the sequence data is data expressed in MIDI (Musical Instrument Digital Interface) format.

Since the schedule table defines a reproduction schedule of the audio data and the sequence data, a reproduction performance is allowed to be executed based on a complicated combination of the above two sorts of data. Preferably, the audio data and the sequence data are marked with times corresponding to events and the reproduction schedule is programmed in units of the events.

Further, the automatic playing apparatus is provided with a signal receiving means which receives audio data, sequence data, both relating to a transferred musical piece, and a schedule table which defines a reproduction schedule of the audio data and the sequence data. In the above arrangement, the audio data storing means, the sequence data storing means and the schedule table storing means will store data sent from the above receiving means.

The receiving means can receive data through a telephone network from a data base center which supplies data of musical pieces. Further, the receiving means receives these data by radio or through a satellite data transmitting network.

According to another aspect of the present invention, there is provided an automatic playing apparatus, which comprises:

external memory means of a random access type for storing audio data and sequence data;

schedule table storing means for storing a schedule table which defines a schedule for reproduction of the audio data and the sequence data stored in said external memory means;

first buffer means for receiving the audio data from said external memory means and temporarily storing the received audio data;

audio output means for reproducing an audio signal based on the audio data, when the audio data stored in said first buffer means is supplied thereto;

second buffer means for receiving the sequence data from said external memory means and temporarily storing the received sequence data;

musical-tone generating means for generating musical tones based on the sequence data, when the sequence data stored in said second buffer means is supplied thereto;

data transfer means for selectively executing, in predetermined order of priority, data transfer between said audio output means and said first buffer means, data transfer between said musical-tone generating means and said second buffer means, data transfer between said external memory means and said first buffer means and data transfer between said external memory means and the second buffer means; and control means for controlling said data transfer means so as to transfer the audio data from said external memory means to said first buffer means and to transfer the sequence data from said external memory means to said second buffer means, in accordance with the schedule table stored in said schedule table storing means.

The automatic playing apparatus with the above structure can execute a musical performance in accordance with the schedule table, using the audio data and the sequence data.

Therefore, reproduction of audio data and performance of sequence data included in one musical piece can be combined in various manners, allowing a musical performance full of variety to be executed in various ways.

It would be apparent for those skilled in the art from the following description of preferred embodiments that the present invention ma be modifies in various manners as well as applied to other cases.

BRIEF DESCRIPTION OF THE DRAWINGS

The above and other objects and structures of the present invention would be understood by those skilled in the art from the description of the preferred embodiments with reference to the accompanying drawings in which:

FIG. 5 is a view showing an event address table in transferred music data;

FIG. 7 is a view showing an event sequence schedule in transferred music data;

DETAILED DESCRIPTION OF THE PREFERRED EMBODIMENTS

Now, an embodiment of the present invention will be described with reference to the drawings.

<System Structure>

Figure 1:
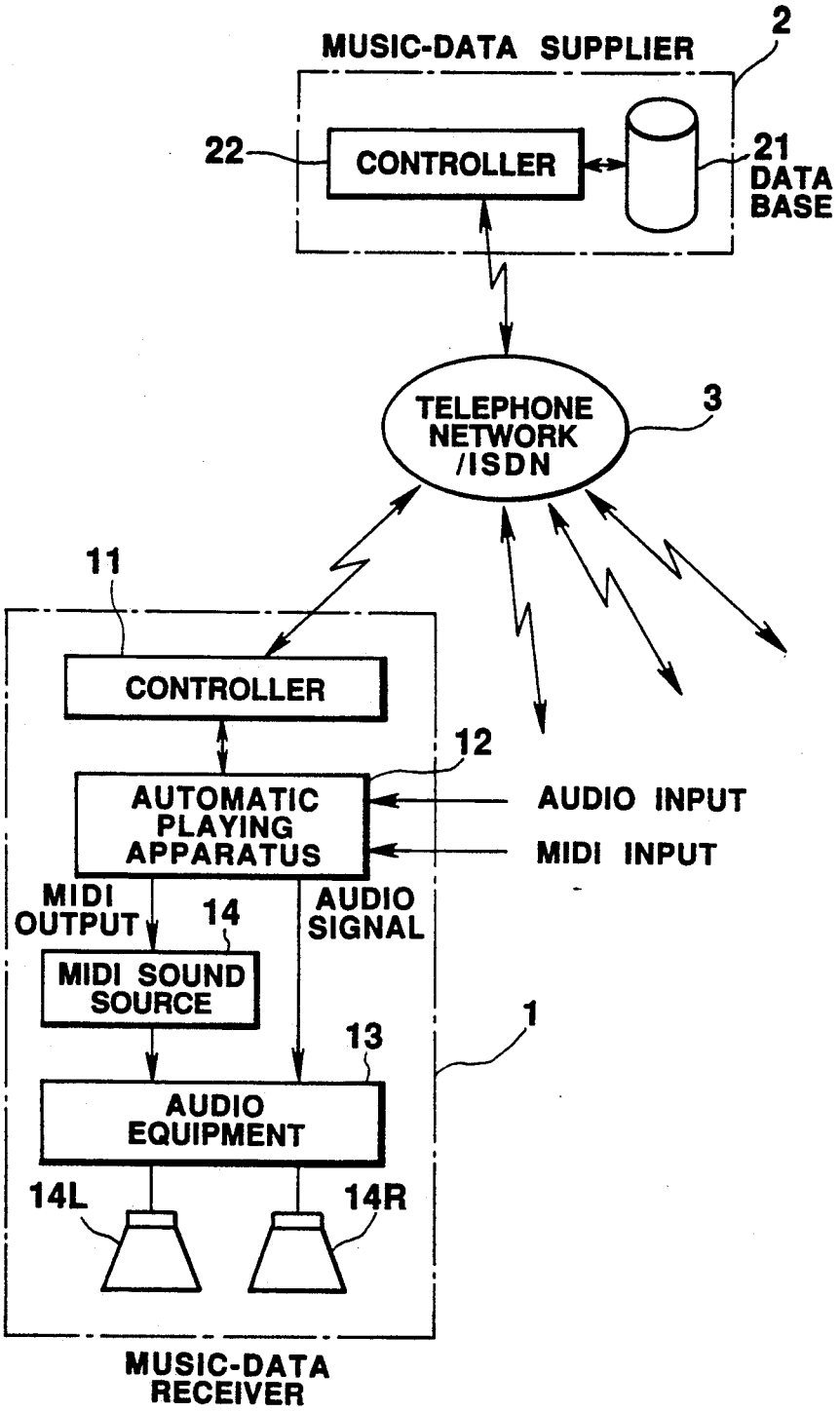
FIG. 1 is a block diagram of a whole system according to the present invention.

FIG. 1 is a view illustrating a whole structure of a system to which an automatic playing apparatus of the present invention is applied. In FIG. 1, a reference numeral 1 stands for a music-data receiver, to which data of number of musical pieces stored in data base 21 in a music-data supplier (data-base center) 2 are supplied through a telephone network or an Integrated Service Digital Network (ISDN) 3 under control of a controller 22. Data of a musical piece which is requested through the music-data receiver 1 is transferred from the music-data supplier 2 to the music-data receiver 1. The above data of a musical piece is composed of audio data, sequence data and schedule table, to be described later, which defines a schedule showing a combination of the audio data and the sequence data to be used.

The transferred data are controlled by a controller 11 in the music-data receiver 1 and supplied to an automatic playing apparatus 12. Further, the automatic playing apparatus 12 receives an audio input and a MIDI input from the outside, and has a function of recording the received data. The automatic playing apparatus 12 reproduces and supplies the recorded audio data to an audio equipment 13, and further reproduces a MIDI signal, i.e., recorded sequence data and sends a MIDI output to a MIDI sound source 14. The MIDI sound source 14 generates musical tones having corresponding tone pitches, and outputs them to the audio equipment 13.

Accordingly, an audio signal and a musical-tone signal transmitted from the MIDI sound source 14 are output audibly and stereophonically through speakers 14R and 14L.

<Structure of Automatic Playing Apparatus 12>

Figure 2:
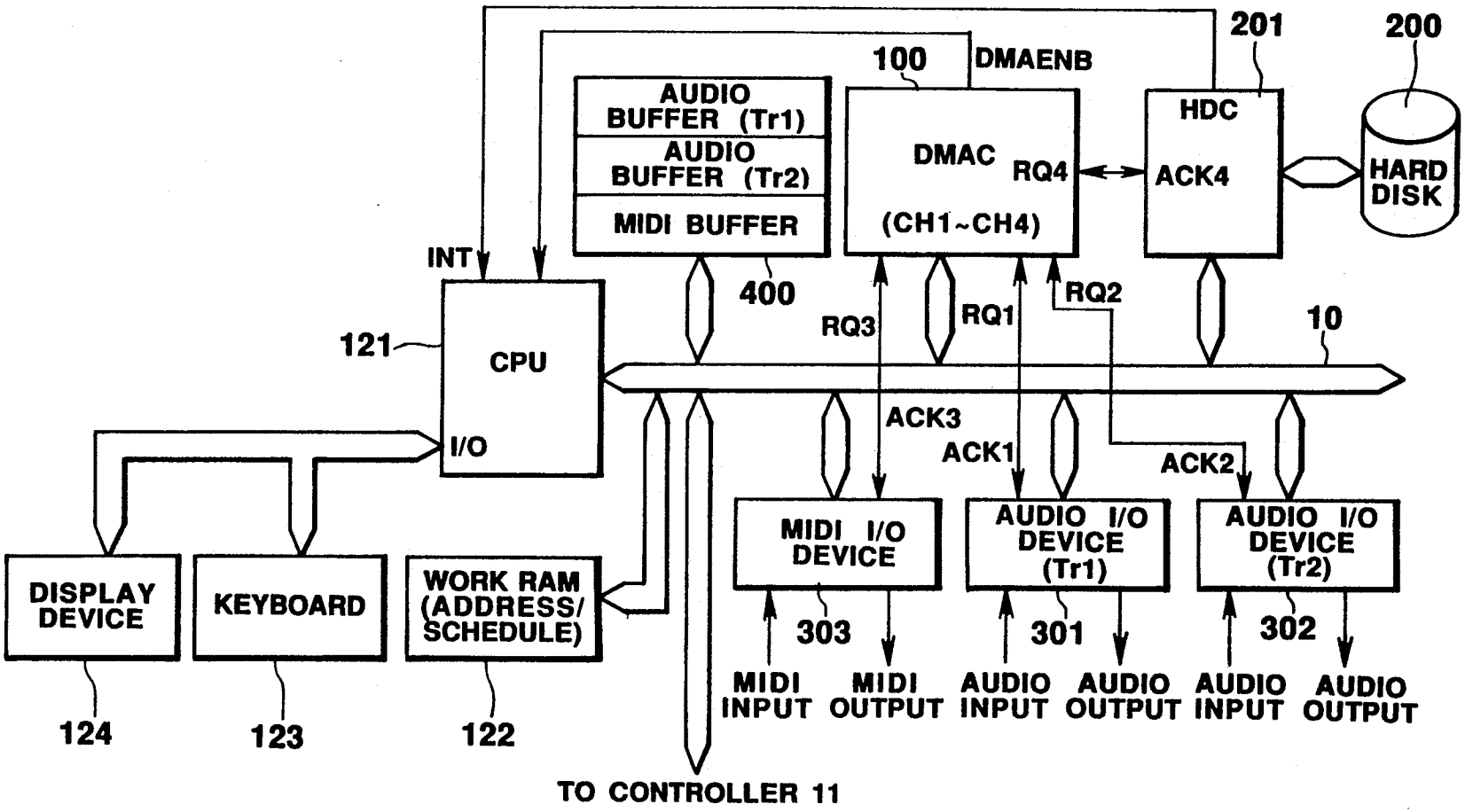
FIG. 2 is a circuit diagram of an automatic playing apparatus of FIG. 1.

FIG. 2 is a view showing a detailed structure of the automatic playing apparatus 12 of FIG. 1, which is an essential portion of the present invention.

Data from the controller 11 is supplied to an internal bus (data bus/address bus) 10 and is stored in a hard disk 200 as will be described later. Whole operation of the automatic playing apparatus 12 is controlled by a CPU 121. The CPU 121 designates and edits a read/write area of the hard disk 200, using a predetermined area of a work RAM 122. For the purpose, the work RAM 122 stores a read/write address of the hard disk 200 and a music schedule table defining a schedule of order of data to be read out.

To an input/output terminal of the CPU 121 are connected a keyboard 123 and a display device 124, which are used by a user to input various instructions to the CPU 121. More specifically, through the keyboard 123 and the display device 124, the user inputs a request to the music data supplier 2 of FIG. 1 for transmission of his desired music piece and sets operation modes of respective tracks (audio track, sequencer track) and further sets various editing states.

In a real time operation mode (a data record/reproduction mode), the CPU 121 controls individual components of FIG. 2 only when the bus 10 is not occupied. In the real time operation mode, a Direct Memory Access Controller (DMAC) 100 occupies the bus 10. In other words, when the DMAC 100 occupies the bus 10, the CPU 121 is supplied with a DMA enabling signal DMAENB, being prohibited from accessing through the bus 10.

To the bus 10 are connected audio input/output devices (input/output controllers) 301, 302 for two tracks (Tr 1, Tr 2), a MIDI input/output device (input/output device) 303, a buffer 400, a hard disk controller (HDC) 201 in addition to the above CPU 121, the work RAM 122 and the DMAC 100.

The DMAC 100 is composed of four channels CH 1 to CH 4. The channel CH 1 is prepared for DMA transfer (single transfer) between an audio buffer (Tr 1) in the buffer 400 and the audio input/output device 301. The channel CH 2 is prepared for DMA transfer (single transfer) between an audio buffer (Tr 2) in the buffer 400 and the audio input/output device 302. These audio buffers are of a ring buffer type, and can temporarily store audio data for a plurality of samplings. The channel CH 3 is prepared for DMA transfer (packet transfer) between a MIDI buffer in the buffer 400 and the MIDI input/output device 303. The MIDI buffer is of a ring buffer type too, and temporarily stores MIDI data for a plurality of samplings.

The channel CH 4 is used for data transfer (DMA transfer, block transfer) between areas in the buffer 400 and the corresponding areas of the hard disk 200. In the data reproduction mode, it is judged whether or not there is an appropriate empty space in the designated area of the buffer 400, and then data transfer between the hard disk 200 and the buffer 400 is executed based on the result of the judgement. In the data record mode, it is judged whether or not there is an appropriate block to be transferred to the hard disk 200 in the designated area of the buffer 400, and then the data transfer is executed based on the result of the judgement.

The hard disk 200 is connected to the HDC 201, and the read/write operation of data of the hard disk is executed under control of the HDC 201. The hard disk 200 stores data of a musical piece transferred from the outside and data of a musical piece which the user obtained by performing an input operation as described above. The HDC 201 is controlled to be programmed by the CPU 121 every time data transfer of one block of data is effected for the following data transfer.

The audio input/output devices 301, 302 are arranged such that they are capable of exchanging an audio (voice) signal with an external device. The audio input/output devices each include a D/A convertor and an A/D convertor, and converts an analog signal supplied from the outside into a digital signal (for example, a PCM signal) and converts a digital audio signal into an analog signal. The audio input/output devices 301, 302 generate DMA transfer request signals RQ 1, RQ 2 to the DMAC 100 in synchronism with a sampling clock signal (an output of internal clock generator or a sampling clock externally supplied thereto).

CH 1 and CH 2 of the DMAC 100 send back acknowledge signals ACK 1, ACK 2 to the audio input/output devices 301, 302 to perform data transfer in response to the transferred request signals RQ 1, RQ 2, and occupy the bus 10, executing DMA transfer. In this case, the DMAC 100 generates and sends a predetermined read/write signal (not shown in FIG. 2) to the audio input/output devices 301, 302. Further, the DMAC 100 supplies the DMA enabling signal DMAENB to the CPU 121 to indicate that the DMA transfer is on.

The MIDI input/out device 303 is so arranged that it can exchange MIDI signal (MIDI message) with an external device, and includes a convertor for effecting a serial/parallel conversion of the MIDI message to a MIDI output and a parallel/serial conversion of a MIDI input, and further includes a timer for controlling the timing of input output of the MIDI message.

As will be described later, in the data reproduction mode, the timer of the MIDI input/output device 303 judges a timing from the last MIDI output in accordance with interval (time) data of one packet, and outputs a MIDI data portion of a packet. Meanwhile, in the data record mode, with respect to a MIDI input, the timer combines input data with interval (time) data which is representative of a time interval from a time when the last MIDI data is input, forming the input data into a packet.

The MIDI input/output device 303 judges a timing with the timer, generating a DMA transfer request signal RQ 3 to the DMAC 100.

The channel CH 3 of the DMAC 100 sends back an acknowledge signal ACK 3 to the MIDI input/output device 303 and occupies the bus 10 to execute DMA transfer in response to the request signal RQ 3. Further, the DMAC 100 sends a predetermined read/write control signal (not shown in FIG. 2) to the MIDI input/output device 303, and simultaneously supplies the above DMA enabling signal DMAENB to the CPU 121.

The HDC 201 sends the DMAC 100 a request signal RQ 4 for data transfer between the hard disk 200 and desired area of the buffer 400 in accordance with the programming of the CPU 121. Similarly, the channel CH 4 of the DMAC 100 occupies the bus 10, executing DMA transfer in response to the request signal RQ 4. In other words, the DMAC 100 sends the HDC 201 an acknowledge signal ACK 4 to execute data transfer between the hard disk 200 and the designated buffer in the buffer 400. The DMAC 100 sends the predetermined read/write control signal R/W to the HDC 201.

Meanwhile, a plurality of request signals RQ can be sent to the DMAC 100 at the same time. In this case, the DMAC 100 control to execute DMA transfer in the order of the priority: RQ 1, RQ 2, RQ 3, RQ 4. The order of the priority is decided depending on an emergency of DMA transfer.

Data transfer of an audio signal has to be executed precisely every sampling operation or the reproduced audio signal is rendered acoustically unnatural. On the contrary, timings of data transfer of the MIDI signal are not so severe as those of the audio signal. The channel CH 4 executes data transfer between the hard disk 200 and the buffer 400. Since there is left a time margin for the buffer 400, no particular problem will be caused, even though other DMA transfer should be requested during the data transfer between the hard disk 200 and the buffer 400 and the data transfer is interrupted to allow the other DMA transfer to be executed.

<Structure of DMAC 100>

Figure 3:
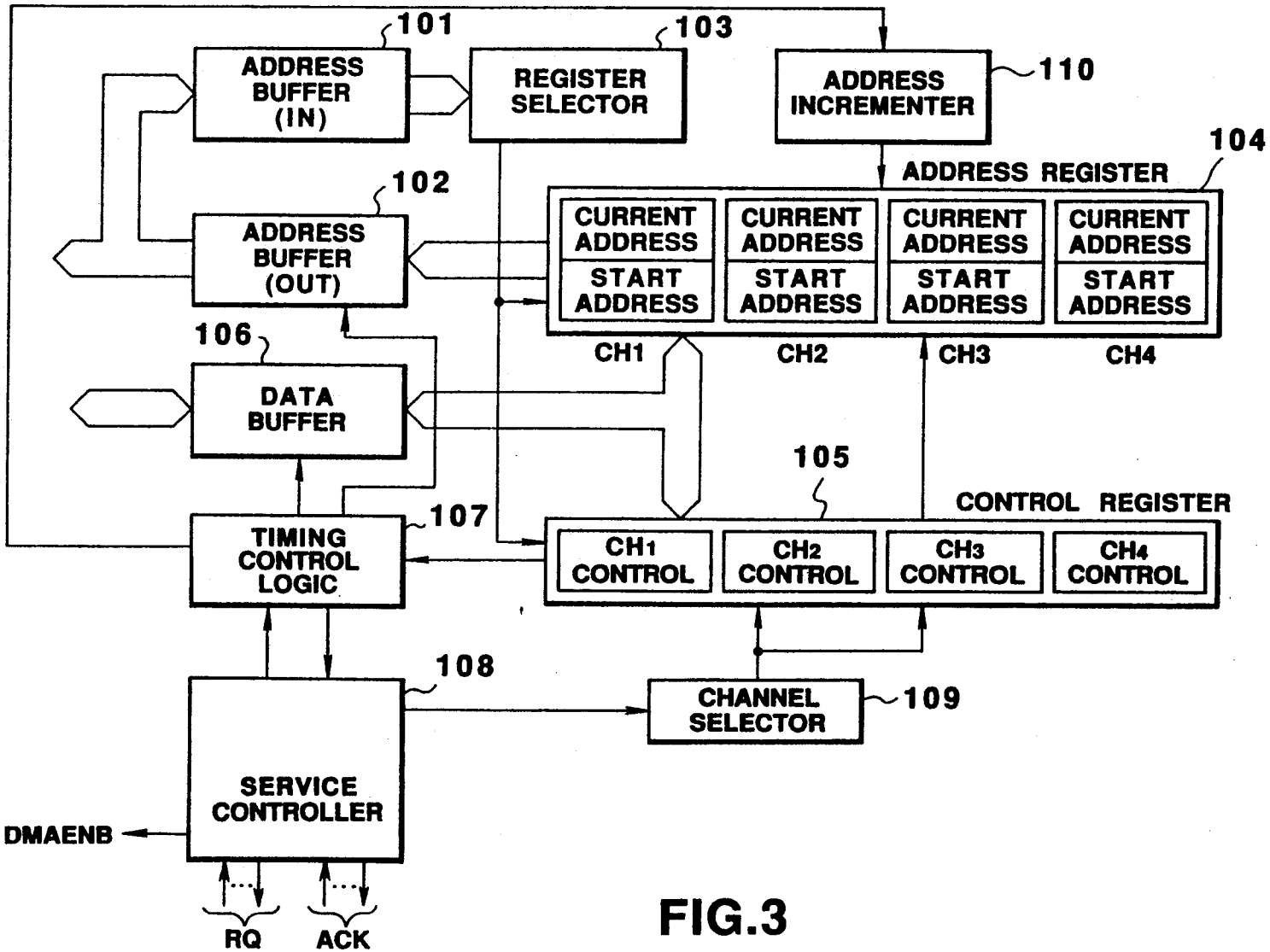
FIG. 3 is a circuit diagram of DMAC 100 of FIG. 2.

One example of a structure of the DMAC 100 will be described. As shown in FIG. 3, the DMAC 100 is of 4 channel arrangement. The channels CH 1, CH 2 correspond to the audio tracks Tr1, Tr2, respectively. These channels CH 1, CH 2 execute data transfer (single transfer) of audio data in every sampling between the audio input/output devices 301, 302 and the buffer 400. The channel CH 3 corresponds to the MIDI track, and executes data transfer of MIDI data in ever packet between the MIDI input/output 303 and the buffer 400. The channel CH 4 executes data transfer (block transfer)

between the designated buffer among the buffer 400 and the hard disk 200.

The DMAC 100 has an address buffer (IN) 101 at the input side and an address buffer (OUT) 102 at the output side. A content of a register selector 103 is changed depending on an address signal to be supplied to the address buffer (IN) 101 at the input side, and desired registers in an address register 104 and a control register 105 will be designated.

As described above, the address register 104 and the control register 105 include registers corresponding to four channels CH 1 to CH 4, respectively. The address register 104 has area for storing at least current addresses and start addresses of areas corresponding to the buffer 400, and the control register 105 stores, for example, control data for deciding a direction in which the DMA transfer is executed.

Contents of the address register 104 and the control register 105 are available for a input/output operation to transfer them through a data buffer 106 to or from the bus 10. These respective components are controlled by a timing control logic circuit 107, a service controller 108 and a channel selector 109.

The service controller 108 is of a hard logic control type or of a microprogram control type. The service controller 108 receives a signal from the timing control logic circuit 107 and DMA transfer request signals RQ 1 to RQ 4 from the audio input/output devices 301, 302, the MIDI input/output device 303 and the HDC 201, and further receives various control signals from CPU 121, and outputs acknowledge signals ACK 1 to ACK 4 to these components in response to the signals sent therefrom. The service controller 108 further outputs various control instructions to the timing controller 107.

The channel selector 109 selectively designates registers corresponding to respective channels CH 1 to CH 4 in the address register 104 and the control register 105.

Receiving a control signal from the service controller 108, the timing control logic circuit 107 controls input-/output operations of the address buffer 102 and the data buffer 106. Further, the timing control logic control 107 allows an address incrementor 110 to operate to increment a current address of the designated channel in the address register 104. Note that, when the current addresses of the respective channels have been reached the final addresses, the address incrementor 110 sets the start addresses of the respective channels as the current addresses respectively. As described above, the respective areas in the buffer 400 are arranged as ring buffers, respectively.

<Contents memorized in Hard Disk 200>

Figure 4:
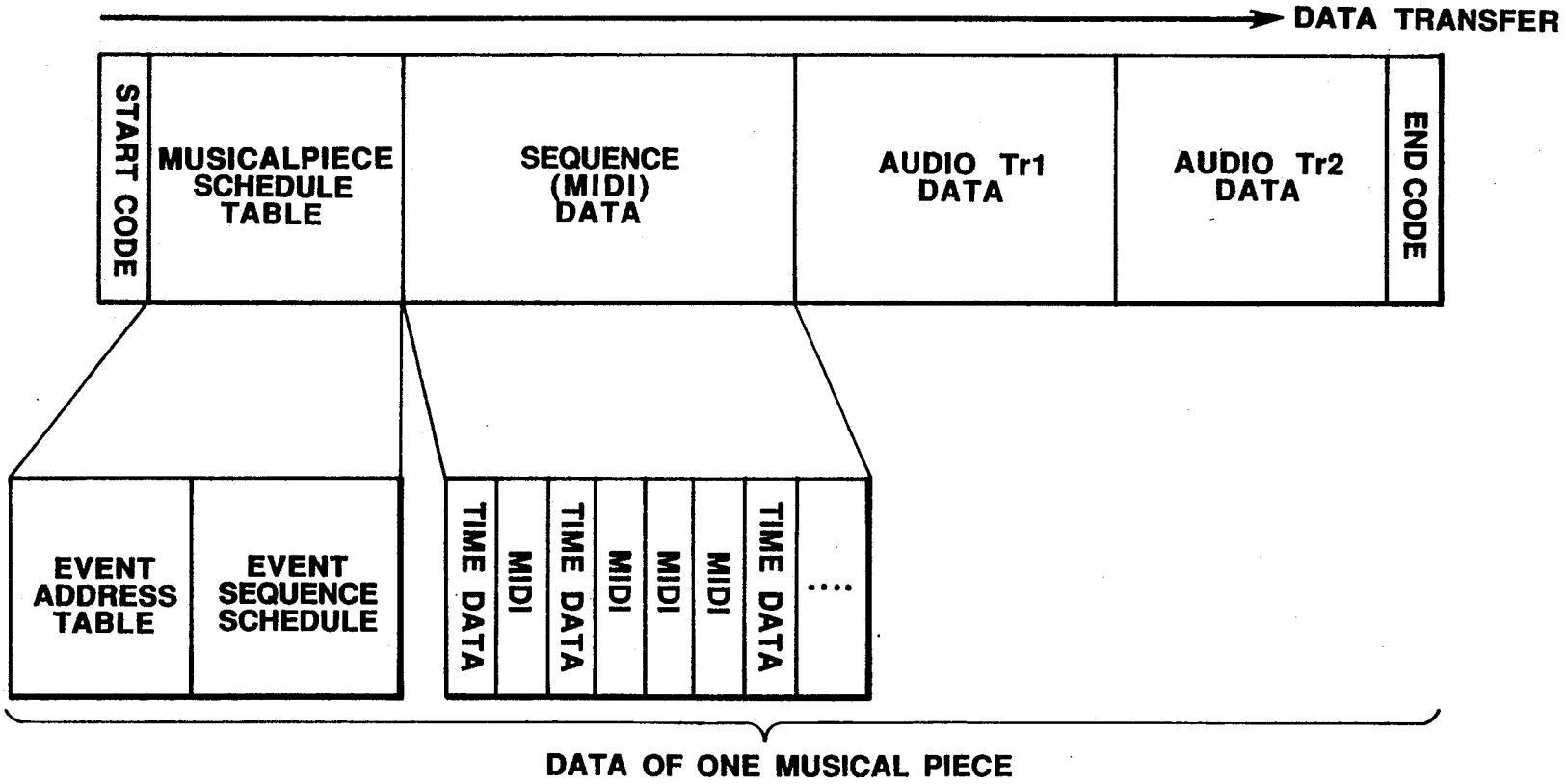
FIG. 4 is a view showing contents of data of a musical piece (hereafter, referred to as "music data") to be transferred.

In FIG. 4 is illustrated one example of a data format of one musical piece stored in the hard disk 200. Data transferred from the music data supplier 2 is also arranged in the above data format. In the example, data of one musical piece is roughly divided into four areas. Note that data of a plurality of musical pieces are stored similarly in the hard disk 200. Next to an area for a start code, there are provided an area for musical piece schedule table for deciding performance schedule of a musical piece, an area for sequence (MIDI) data for exchanging data with the MIDI buffer in the buffer 400, and two areas for data of audio tracks (Tr 1, Tr 2) for exchanging data with the audio buffers on the buffer 400. And at the end, there is provided an area where an end code is stored.

The musical piece schedule table includes an event address table and an event sequence schedule.

More specifically, the event address table is exemplarily illustrated in FIG. 5. A plurality of MIDI data are registered as one event, and relative address data of each event are stored as a table in the event address table. In other words, data supplied from the music data supplier 2, as will be described below, are previously divided into events, and, when a relative address of data of each event is designated, an absolute address may be calculated from a particular reference address of the hard disk 200 and the designated relative address. Taking an event 4 as an example, the start address is Ad0007 and the end address is Ad0008. By performing an arithmetic operation on these relative addresses and the reference address, actual addresses on the hard disk 200 may be obtained. As described above, addresses of each event are decided, and edition of data for each event may be executed without actually rewriting data A part of the musical piece to be repeated may be repeatedly reproduced by repeatedly designating the addresses, when the part has been registered as one event. Similarly, audio data is divided into a plurality of events, the relative addresses (the start address and the end address) of each event are stored in the event address table, as shown in FIG. 5.

Figure 6:
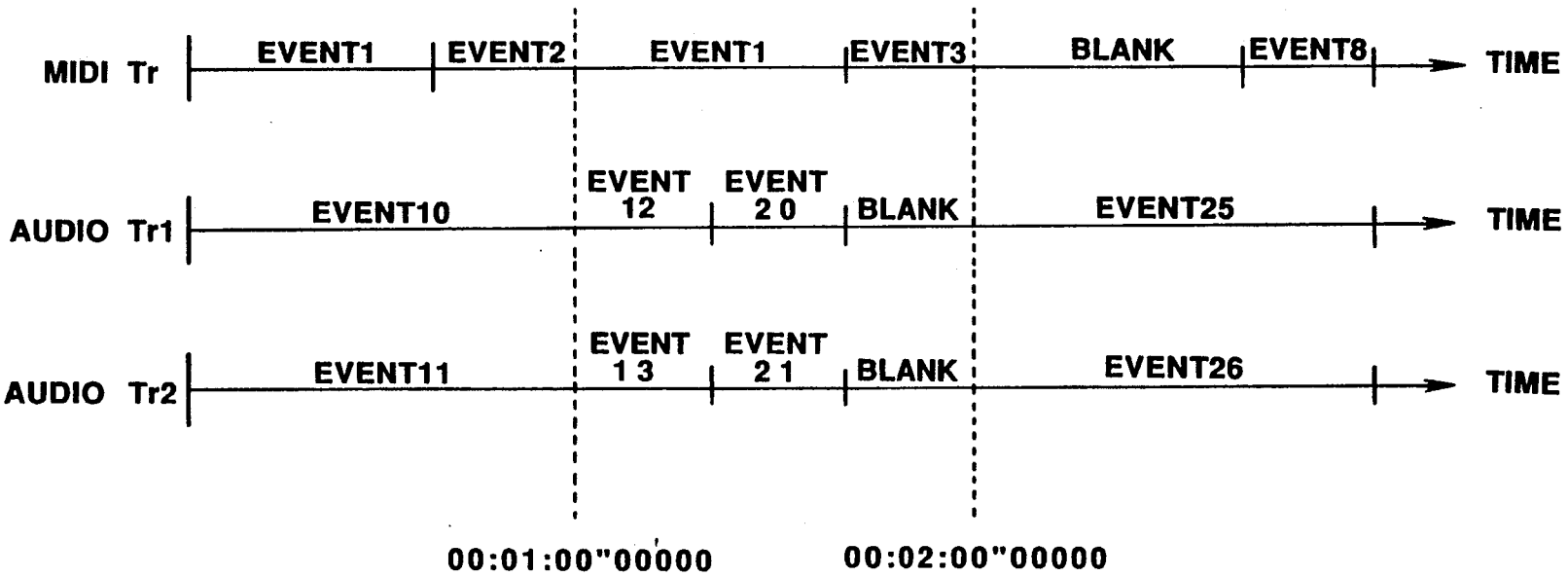
FIG. 6 is a view showing a reproduction state of a plurality of events in transferred music data.

The event sequence schedule is prepared to decide in which order these events are used. FIG. 6 is a view illustrating events which are disposed along a time axis, and specific contents of these events are illustrated in FIG. 7. More specifically, with respect to the MIDI track, events are previously programmed to be reproduced in the order of event 1, event 2, event 1, and so on. For the audio track Tr 1, events are programmed to be reproduced in the order of event 10, event 12, event 20, and so on. For the audio track Tr 2, events are programmed to be reproduced in the order of event 11, event 13, event 21, and so on.

As will be understood from views of FIGS. 6 and 7, with respect to three tracks (one track for a MIDI signal, two tracks for audio signals), orders of events are defined in the event sequence schedule, in which orders the events are to be read from the hard disk 200 and reproduced in response to changes in time (H), minute (M) and second (S) and sample (time data less than one second for designating sample numbers because several audio samples of audio data are read out in one second).

Note that, in FIG. 6, "blank" stands for an instruction for ceasing generation of a musical tone (for MIDI track) or for ceasing reproduction of the audio signals (for audio tracks).

In this manner, MIDI data expressed in a unit of events and audio data are appropriately combined depending on the musical piece and stored in the hard disk 200 for later reproduction.

In the areas of the hard disk 200 for storing sequence data, as shown in FIG. 4, there are stored timing data for timing control purpose and MIDI data (MIDI message) of not less than 0 byte. Byte length of MIDI message is arbitrary and varies depending on contents of MIDI data which are generated from time to time. MIDI data of 0 byte serves simply to provide a certain time interval. The data of a variable byte length is a fundamental unit of DMA transfer.

Audio data are stored in two tracks, for example, as data of 16 bits expressed in a sampling unit. The sampling frequency of the audio data is, for example, 48 KHz. In the two tracks, left channel audio data and right channel audio data may be stored respectively for the stereophonic reproduction purpose. Different audio parts (for example, sounds are divided into sounds of musical instruments and vocal sounds) may be arranged to be separately stored in the two tracks and to be selectively reproduced. Increasing number of tracks will also allow a multiple-track performance.

Data transfer between the hard disk 200 and the buffer 400 is not always executed in the above mentioned unit, but it will be enough that the order of data to be stored and reproduced from the hard disk 200 merely corresponds to the order of data to be stored and reproduced from the buffer 400. What is important for that purpose is that the unit is controlled as described above, in which unit data transfer between the buffer 400 and the respective input/output devices 301 to 303 is executed.

<Operation of CPU 121>

Figure 8:
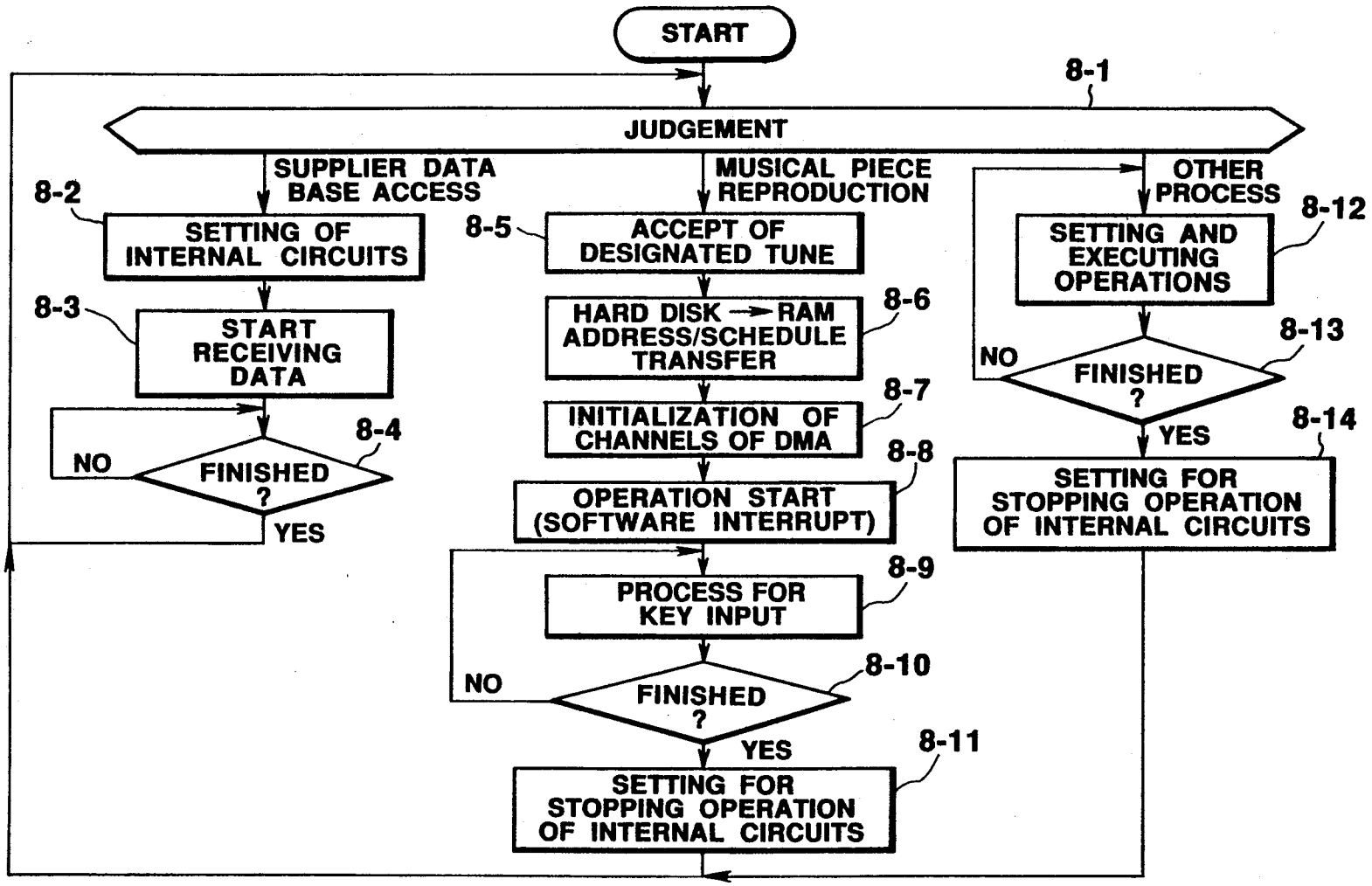
FIG. 8 is a flow chart of a main routine process of CPU of FIG. 2.
Figure 9:
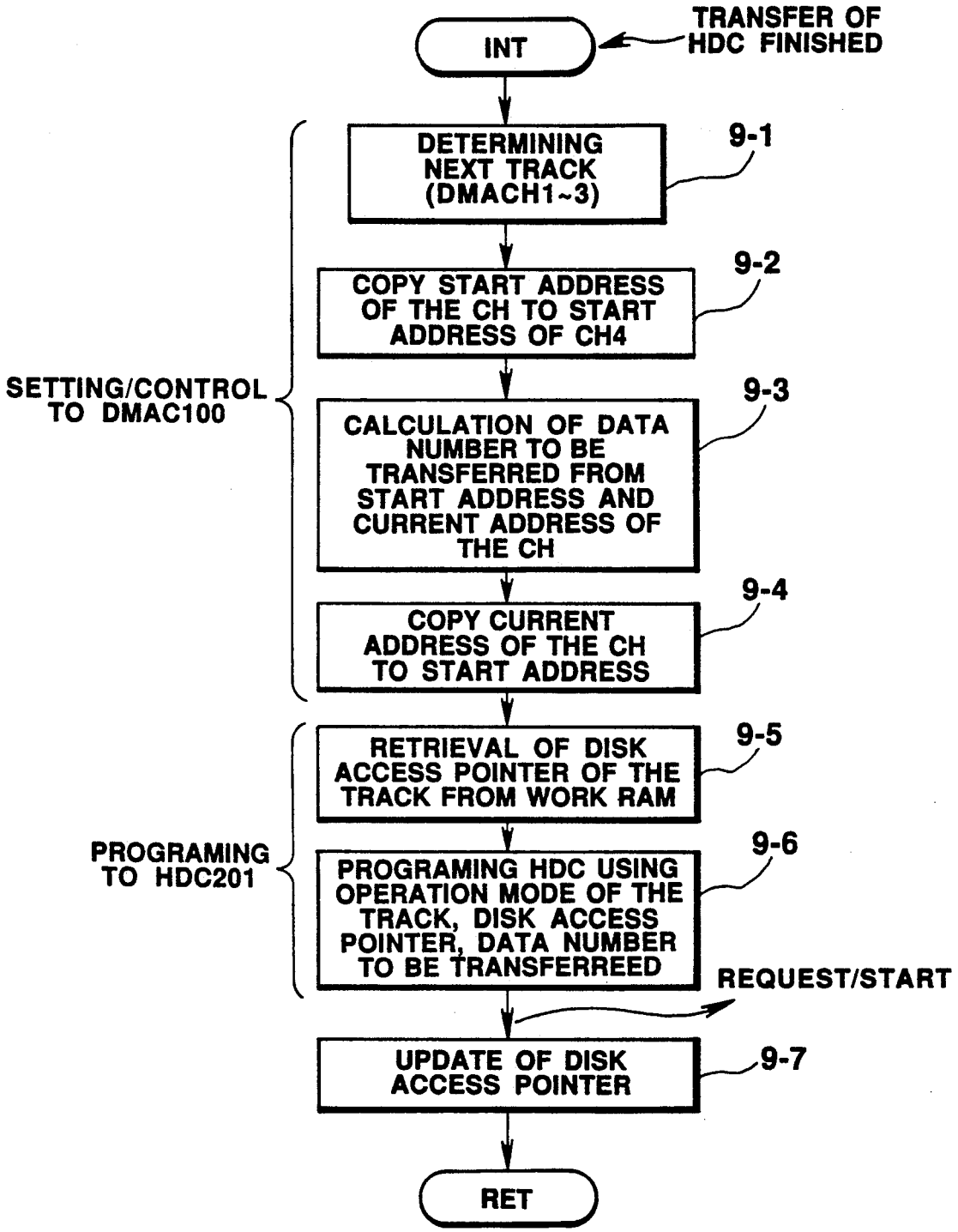
FIG. 9 is a flow chart of an interrupt routine process of CPU of FIG. 2.

Now, operation of the present embodiment will be described with reference to flow charts of FIG. 8 and 9. FIG. 8 is a main flow chart of operation of the CPU 121, and FIG. 9 is an interrupt routine operation of the CPU 121.

In FIG. 8, the CPU 121 judges at step 8-1 what instruction has been designated through the keyboard 123 by the user. When an instruction to transfer data of a particular musical piece has been sent to the music data supplier 2, the CPU 121 goes to step 8-2, where the CPU 121 executes setting operations for circuits within the automatic playing apparatus 12. At step 8-3, the automatic playing apparatus 12 is made ready for receiving the musical piece data. In the automatic playing apparatus 12, the buffer 400 sequentially receives the musical piece data through the controller 11 and the bus 10, and then the received musical piece data are written into the hard disk 200. The CUP 121 executes this writing operation by using a particular channel of the DMAC 100, and will continuously execute this writing operation until a "FINISH" is detected at step 8-4.

When all of musical piece data has been received, the CPU 121 returns to step 8-1, where the CPU 121 waits for another instruction from the user. In accordance with the user's instruction, data of one musical piece or data of a plurality of musical pieces may be transferred from the music data supplier 2 and stored in the hard disk 200.

When it is judged at step 8-1 that a play back mode has been set, the operation advances to step 8-5, where a designation of a musical piece to be played is accepted. At step 8-6, the musical piece schedule table, i.e., the event address table and the event sequence schedule are transferred from the hard disk 200 to the work RAM 122 to be stored therein. The operation of reading data from the hard disk 200 and operation of transferring data to the work RAM 122 are executed through a particular channel of the DMAC 100.

At step 8-7, the respective channels of the DMAC 100 are initialized for executing an actual playing operation. In other words, the channels of the DMAC 100 are set so as to allow data transfer to be effected through the buffer 400.

A software interrupt is caused at step 8-8 for the CPU 121 to perform an interrupt routine operation shown in FIG. 9 for starting operation. At this time, in accordance with the musical piece schedule table stored in RAM 122, it is decided from which area of the hard disk 200 data should be read out.

At step 9-1 of FIG. 9, a track is decided on which next data transfer is to be executed. If all the track are in operation, the order of the priority will be CH 1, CH 2, CH 3 and CH 4 and the DMA channel CH 1 corresponding to the audio track Tr 1 therefore is decided at step 9-1 as the track for the data transfer. If the track Tr 1 is set for the play back operation, block transfer of digital audio data will be executed from the hard disk 200 to the audio buffer (Tr 1) of the buffer 400. If the track Tr 1 is set for the recording operation, block transfer of digital audio data will be executed from the audio buffer (Tr 1) of the buffer 400 to the corresponding area of the hard disk 200.

In other words, the start address of the channel CH 1 of DMAC 100 is copied as the start address of the channel CH 4 at step 9-2. At the following step 9-3, number of data to be block-transferred is calculated from the start address and the current address of the channel CH 1. At step 9-4, the current address at present is set as the start address of the relevant channel (now, channel CH 1) after the block transfer has been effected.

Through steps 9-1 to 9-4, the CPU 121 effects various setting and controlling to the DMAC 100, and then goes to step 9-5, where the CPU 121 reads a disk access pointer of the relevant track of the hard disk 200 stored in the work RAM 122. At step 9-6, the CPU 121 programs the HDC 201 on the basis of the operation mode of the track Tr 1 which is determined in accordance with the contents of the area of the channel CH 1 in the control register 105 of the DMAC 201, the desk access pointer of the track Tr 1 and the number of data to be transferred decided at step 9-3. When an event is changed, events to be transferred are switched in accordance with the contents of the musical piece schedule table. That is, in accordance with a time lapsed after the star of reproduction and states of transferred data of respective events, the CPU 121 realizes the switching of events by properly programs the contents to be transferred with respect to the HDC 201.

As a consequence, the HDC 201 requests DMAC 100 to execute DMA transfer on the track Tr 1 in the designated direction. Responsive to the request, the DMAC 100 will execute the designated DMA transfer.

At the following step 9-7, the CPU 121 updates the disk access pointer of the track Tr 1 in the work RAM 122 to a value which will be reached when the above DMA transfer is finished.

Thereafter, all of the data transfer between the hard disk 200 and the buffer 400 are executed by DMAC 100, and the CPU 121 sets a value of the access pointer of the hard disk 200 at step 9-7 when the data transfer has been finished. Then, the CPU 121 returns to the main routine process of FIG. 8.

As will be understood from the later description, when the interrupt routine operation of FIG. 9 is caused for the first time and the HDC 201 is made active once, the HDC 201 initiates an interrupt every time when block transfer of data designated by the CPU 121 is finished. Therefore, what the CPU 121 does is only to judge whether a key input has been performed by the keyboard 123 and the like, and to execute a process at step 8-9 in response to the result of the judgement. If it is judged at step 8-10 that the reproducing operation of a musical piece has been finished, the CPU 121 sets, at step 8-11, respective circuits shown in FIG. 2 so as to stop their operations, and returns to step 8-1.

If the other process (for example, a process where a user inputs an audio signal for storage or a process for inputting MIDI data for storage) is designated at step 8-1, the CPU 121 goes to step 8-12, where it performs a designated operation. Though the designated operation is not described in detail here, the DMAC 100 mainly serves to execute data transfer between the buffer 400 and the audio input/output devices 301, 302, the MIDI input/output device 303, and data transfer between the hard disk 200 and the buffer 400.

When it is judged that these processes have been finished, the CPU 121 advances from step 8-13 to step 8-14, where the CPU 121 executes a process for causing the internal circuits to stop operations, and then returns to step 8-1.

<Operation of Audio Input/Output Devices>

Operation of the present embodiment, particularly, operation concerning relationship between the audio input/output devices 301, 302 and the buffer 400 or relationship between the audio input/output devices 301, 302 and the hard disk 200 will be described.

Figure 10:
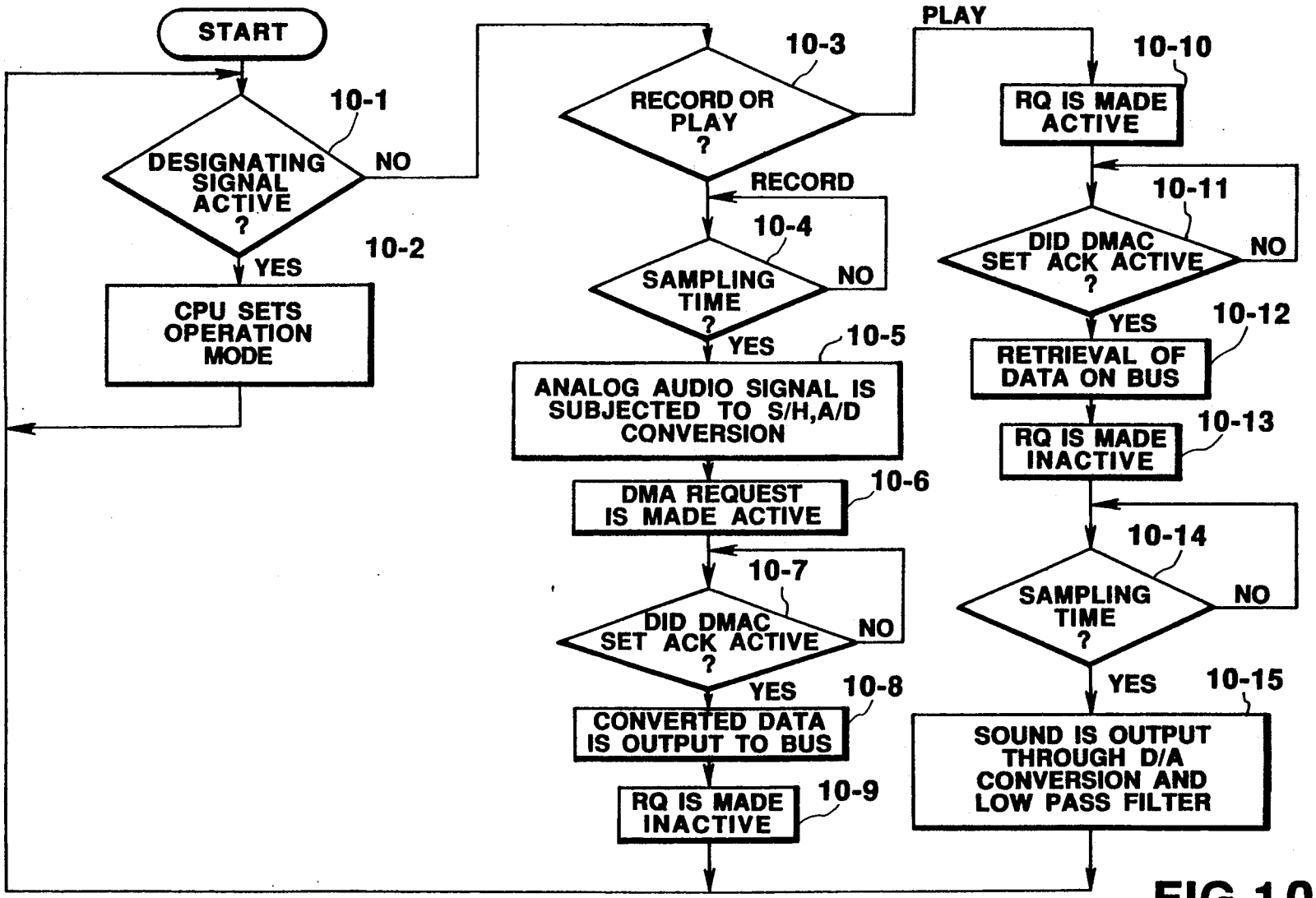
FIG. 10 is a flow chart of operation of audio input-/output devices of FIG. 2.
Figure 14A:
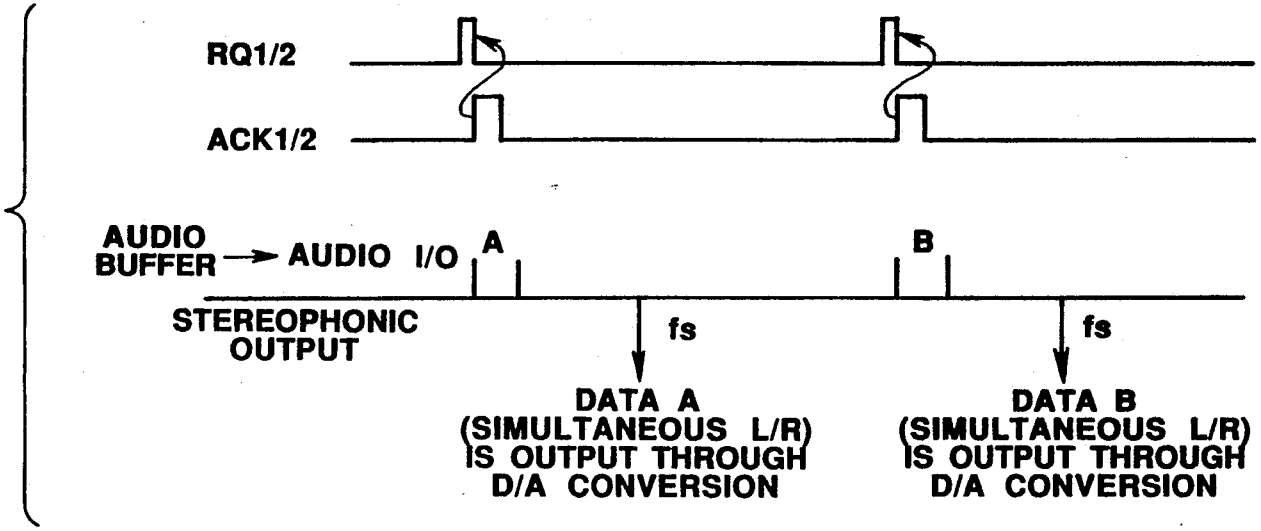
FIGS. 14A and 14B are timing charts illustrating states of data exchange between buffers and audio input/output devices of FIG. 2.
Figure 14B:
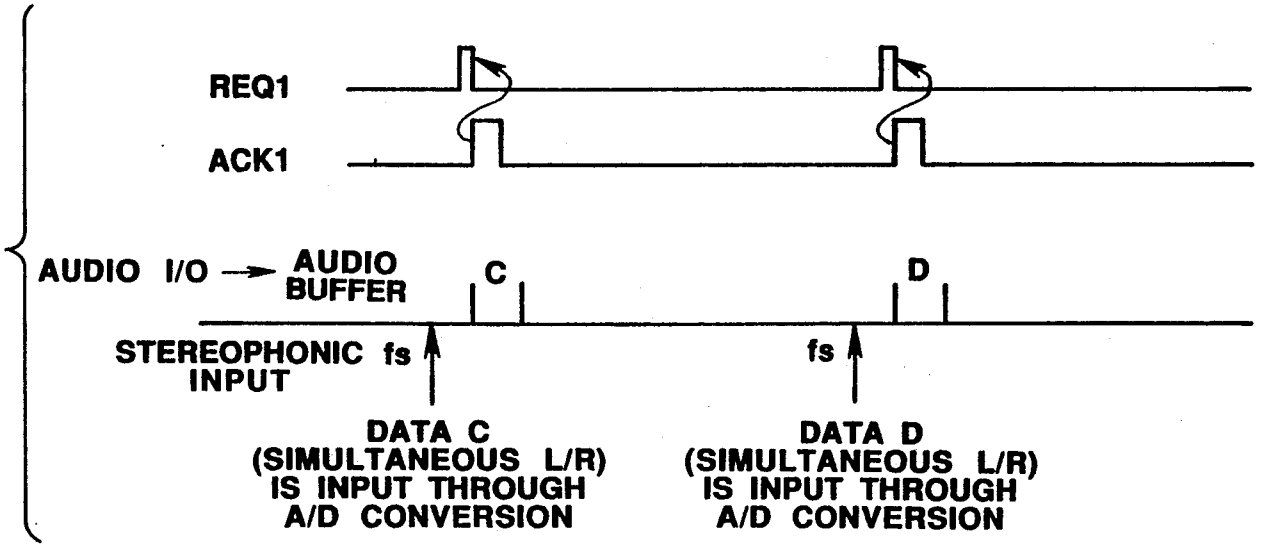
Figure 15A:
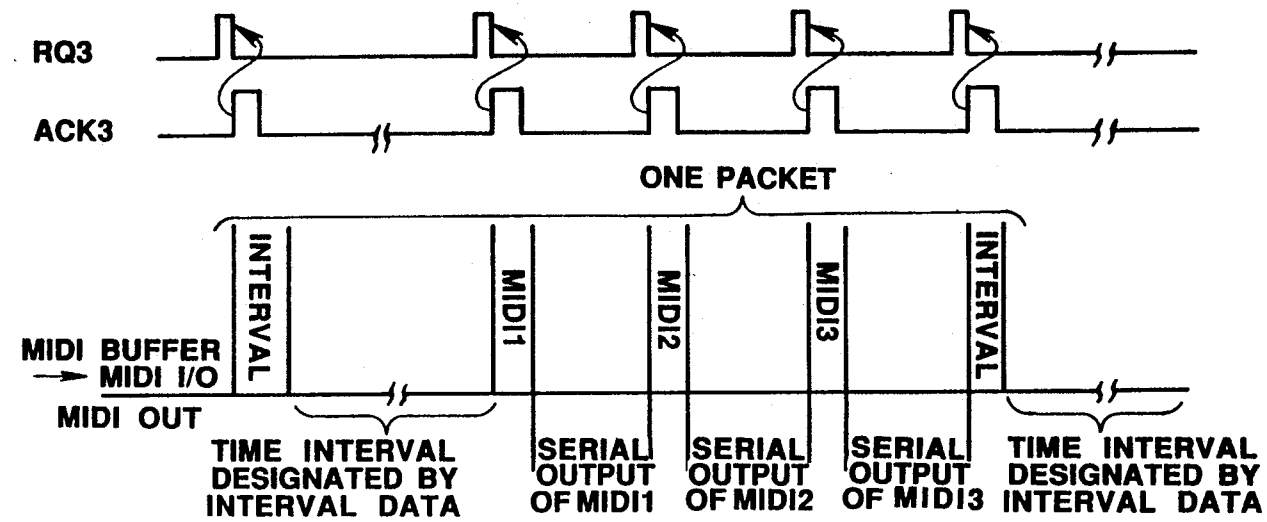
FIGS. 15A and 15B are timing charts illustrating states of data exchange between buffers and a MIDI input/output device of FIG. 2.
Figure 15B:
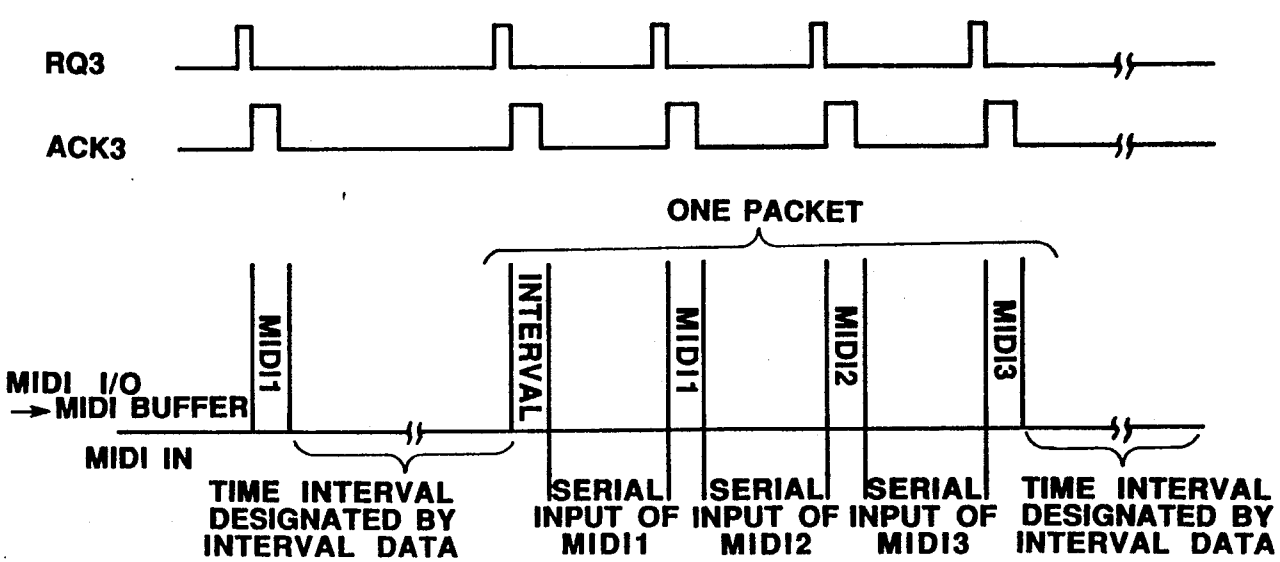

FIG. 10 is a flow chart of operation of the audio input/output devices 301, 302. FIGS. 14A and 14B show time charts of operations of the devices in the play mode and the record mode, respectively.

With reference to FIGS. 14A and 14B, the operations of the audio input/output devices 301, 302 will be described schematically. In the play mode, for previously reading data, the data are successively transferred to the audio buffer Tr 1 or Tr 2 (a part of the buffer 400), which works as a ring buffer, from an audio track area in the hard disk 200. To read audio data from the audio buffer Tr 1 or Tr 2, the audio input/output devices 301, 302 output DMA transfer request signals RQ 1, RQ 2 to the DMAC 100 every sampling time (strictly, before every sampling time (fs)). When the channels CH 1, CH 2 of the DMAC 100 are made ready for DMA transfer, the audio input/out devices 301, 302 receive acknowledge signals ACK 1, ACK 2. Then, data transfer is actually executed form the buffer 400 to the audio input/output devices 301, 302.

Audio data stored in the buffers in the audio input-/output devices 301, 302 are subjected to digital/analog conversion in synchronism with the sampling clock signal (fs) to be outputted as audio signals.

As described above, the audio data read out from the hard disk 200 and stored in the audio buffers are successively read out every sampling time and converted into analog signals. As will be described later, the function of the channel CH 4 of the DMAC 100 executes data transfer of audio data falling in the following block from the hard disk to the audio buffers, before the audio buffers become empty. Therefore, even if the access speed of the hard disk 200 is not so high, the operation of reproducing the audio signal at the sampling time will be effected at a high speed.

In the record mode, an externally supplied stereophonic analog signals are subjected to analog/digital conversion in synchronism with the sampling clock signal (fs), and are stored in the audio buffers in the audio input/output devices 301, 302. The audio input-/output devices 301, 302 send the DMA transfer request signals RQ 1, RQ 2 to the DMAC 100, and execute DMA transfer of the data to the audio buffers Tr 1, Tr 2 in buffer 400 upon receipt of the acknowledge signals ACK 1, ACK 2.

As described above, audio data are successively stored in the audio buffers Tr 1, Tr 2 in the buffer 400 every sampling, and the function of the channel CH 4 in the DMAC 100 executes block transfer of audio data previously stored in the buffer 400 to the hard disk 200, before the audio buffers are filled with data. In this manner, even if the access speed of the hard disk 200 is not so high also in the record mode, the operation of recording the audio signal at the sampling time will be effected at a high speed.

The above operation will be performed in accordance with the flow chart of FIG. 10. The operation may be performed under control of a micro-program or under hard logic control. Various measures for realizing the functions may be selected.

At step 10-1 in FIG. 10, the CPU 121 judges whether a designating signal (not shown in FIG. 2) of the relevant audio input/output devices 301, 302 is active. If YES, the CPU 121 sets the operation mode (record mode, play mode and stop mode) at step 10-2. This setting is performed by the CPU 121 in response to the process at step 8-7 of FIG. 8.

If NO at step 10-1, the CPU 121 judges at step 10-3 whether the audio input/output devices 301, 302 have been set to the record mode or to the play mode. When it is determined that the devices are in the record mode, the CPU 121 advances from step 10-3 to steps 10-4 through 10-9. When it is determined that the devices are in the play mode, the CPU 121 advances from step 10-3 to steps 10-10 through 10-15.

Now, operation of the audio input/output devices 301, 302, which are set to the record mode, will be described. It is judged at step 10-4 whether or not the sampling time is reached, and the process of step 10-4 will be repeatedly executed until the sampling time is reached. Judgement on whether or not the sampling time is reached may be made based on either outputs of hard timers provided in the respective audio input/output devices 301, 302 or the audio input/output devices 301, 302 may be arranged to operate depending on an output of a common hard timer provided for the audio input/output devices. The audio input/output devices 8-1 to 8-4 may be arranged to operate using different sampling frequencies.

When the result of the judgement at step 10-4 is "YES", an input analog audio signal is subject to sample hold (S/H) and is converted to a digital audio signal at step 10-5. At step 10-6, the audio input/output devices 301, 302 make the DMA transfer request signals RQ 1, RQ 2 active and send them to the DMAC 100.

Upon receipt of the active DMA transfer request signals RQ 1, RQ 2, the DMAC 100 outputs the acknowledge signals ACK 1, ACK 2 to effect DMA transfer, as will be described in detail later. When the judgement at step 10-7 is affirmative (YES), the audio input/output devices 301, 302 therefore go to step 11-8, where they output the digital audio signals obtained at step 10-5 to the corresponding buffers Tr 1, Tr 2 via the bus 10, respectively. The analog audio signal externally supplied is converted into the digital audio signal every sampling period and the digital audio signal is transferred to the current addresses of the buffers which are designated by the DMAC 100.

Meanwhile, when it is judged at step 11-3 that the audio input/output devices 301, 302 are in the play mode, the operation goes to step 11-10, where the audio input/output devices 301, 302 make active the DMA transfer request signals RQ 1, RQ 2, and send them to the DMAC 100. Receiving the acknowledge signals ACK 1, ACK 2 from the DMAC 100 at step 10-11, the audio input/output devices retrieve the digital audio signals on the data bus at step 10-12, and then make the above DMA transfer request signals RQ 1, RQ 2 inactive at step 10-13. Though operation of the DMAC 100 at this time will be described later, the contents of the current addresses of the corresponding tracks Tr 1, Tr 2 of the buffer 400 respectively will be input and set to the audio input/output devices 301, 302 through the processes at steps 10-10 to 10-13.

At step 10-14, it is judged whether the sampling time is reached. The judgement is effected in the same manner as at step 10-4. When the judgement at step 10-14 is affirmative (YES), the operation goes to step 10-15, where the digital audio signals are subject to D/A conversion and low pass filtering, and then output the analog audio signals.

The operation of the audio input/output devices 301, 302 at one sampling time, devices which are in the record mode and in the play mode, have been described. After executing the processes at steps 10-9 and 10-15, the audio input/output devices 301, 302 return to step 10-1 and will successively execute the processes for the following sampling time in the similar manner.

The audio input/output devices 301, 302 may be set to the record mode or to the play mode, simultaneously, as described above, but one of these devices may be set to the play mode and the other to the record mode. The audio input/output devices 301, 302 in the play execute playing operation at steps 8-7 to 8-11 of the musical piece reproducing operation of the CPU 121 of FIG. 8, as has been described above.

<Operation of MIDI Input/Output Device>

Operation of the present embodiment, particularly, operation concerning relationship between the MIDI input/output devices 303 and the buffer 400 or relationship between the MIDI input/output device 303 and the hard disk 200 will be described.

Figure 11:
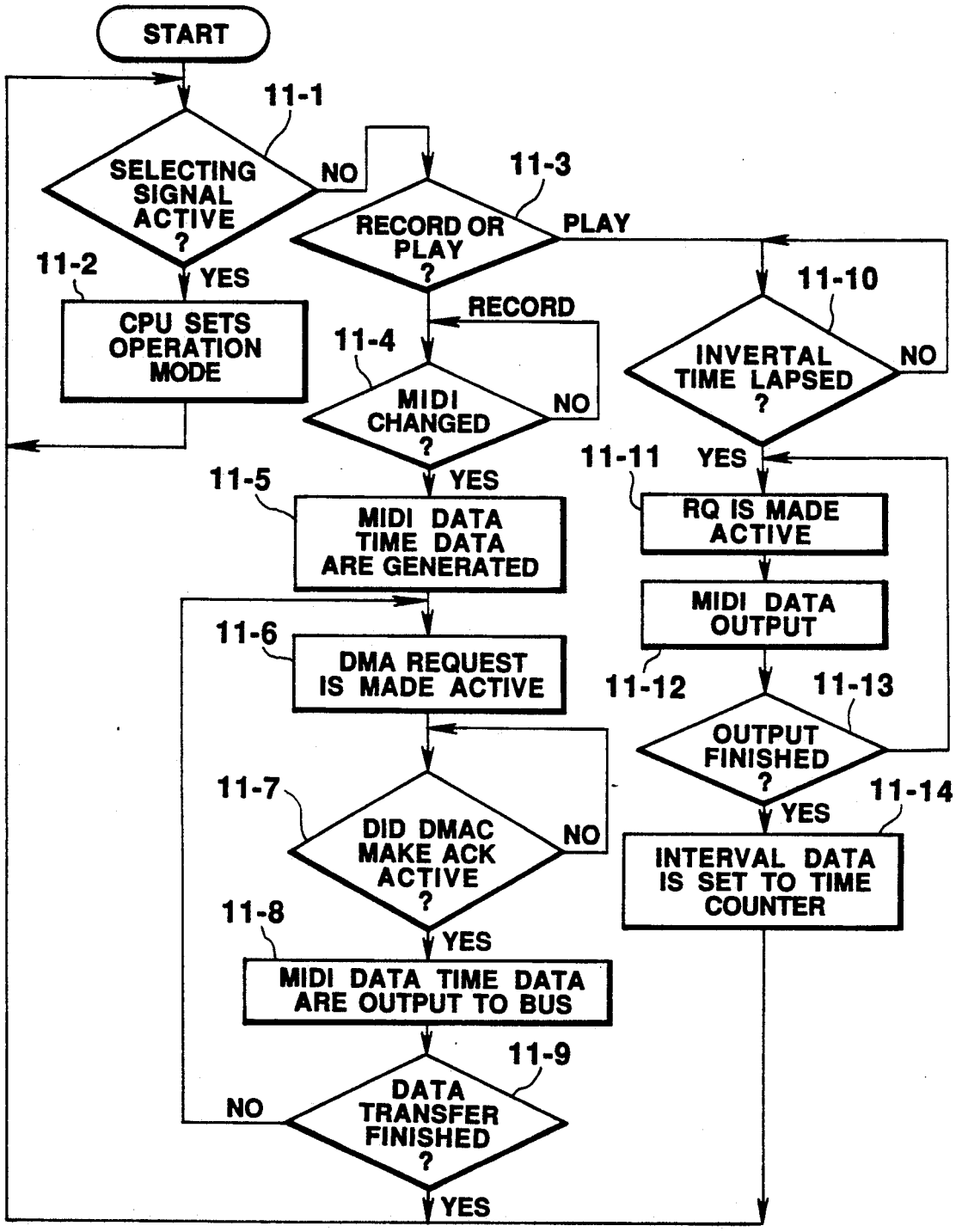
FIG. 11 is a flow chart of operation of a MIDI input-/output device of FIG. 2.

FIG. 11 is a flow chart of operation of the MIDI input/output device 303. FIGS. 14A and 14B show operation of the device in the play mode and in the record mode, respectively.

With reference to FIGS. 14A and 14B, the operation of the MIDI input/output device 303 will be described schematically. In the play mode, the MIDI data for operation of several times are previously transferred from the MIDI track area of the hard disk 200 to the MIDI buffer 400. The data transfer is executed by the channel CH 4 of the DMAC 100.

The MIDI input/output device 303 requests the DMAC 100 for data transfer of interval (time) data among MIDI data concerning one packet (the device sends RQ 3). Upon receipt of the acknowledge signal ACK 3, the MIDI input/output 303 receives the interval data from the MIDI buffer in the buffer 400, and the internal timer starts counting a relevant time interval.

When the MIDI input/output device 303 judges that the time interval has lapsed, the MIDI input/output device 303 sends the DMAC 100 DMA transfer request signal RQ 3. When a MIDI message is transferred from the MIDI buffer in the buffer 400 to the MIDI input/output device 303, the MIDI input/output device 303 executes parallel/serial conversion on the MIDI message, and outputs a serial signal to an external MIDI device. This operation will be repeatedly executed several times corresponding to the number of bytes of a message included in one packet. When these operations have been finished, the MIDI input/output device 303 requests DMA transfer of the following interval data.

As described above, the MIDI data are successively reproduced every time a time designated by the interval data lapses. The contents of the MIDI buffer will sequentially used, and the channel CH 4 of the DMAC 100 execute block transfer of the following MIDI data to the MIDI buffer of the buffer 400 from the hard disk 200 before the MIDI buffer becomes empty.

In the record mode, the MIDI input/output device 303 receives a MIDI data in a serial format from the outside. In the MIDI input/output device 303, the timer measures a time lapse from the input of the last MIDI data to input of a new MIDI data, and the MIDI input/output device 303 sends the transfer request signal RQ 3 to the DMAC 100 to transfer an output of the timer as interval data to the MIDI buffer. Receiving the acknowledge signal ACK 3, the MIDI input/output device 303 executes data transfer to the MIDI buffer of the buffer 400.

The MIDI input/output device 303 executes serial/parallel conversion on the received MIDI data to convert the MIDI data into a parallel signal. Further, the MIDI input/output device 303 executes DMA transfer of the parallel signal to the buffer 400. These operations will be performed several times corresponding to the number of bytes of the current MIDI input.

As the above data transfer is repeatedly executed, MIDI data are sequentially stored in the MIDI buffer of the buffer 400. But the channel CH 4 of the DMAC 100 execute block transfer of MIDI data from the MIDI buffer to the MIDI track area of the hard disk 200, before the MIDI buffer becomes full of the MIDI data.

Even though the access speed of the hard disk 200 is not so high, the above operation allows the buffer 400 to execute record/reproduction operation of MIDI data in a real time.

Now, operation of the MIDI input/output device 303 will be described with reference to the flow chart of FIG. 11. The operation of the MIDI input/output device 303 is similar to those of the audio input/output devices 301, 302, and is performed under control of a micro program or by a hard logic control. Description of the flow chart similar to that of FIG. 10 of the audio input/output devices 301, 302 which have been described will be omitted.

In the record mode, it is judged at step 11-4 whether or not any change has been caused in the MIDI input. When YES, the MIDI input/output device 303 generates as time data the output of the timer which measures a time lapse from the last MIDI input, and retrieves input MIDI data at step 11-5.

The MIDI input/output device 303 goes through steps 11-6, 11-7 to step 11-8, where the device outputs data of one unit, for example, data of one byte to the bus 10 to transfer the data to the MIDI buffer of the buffer 400. In case of the MIDI data, since data transfer of data of several bytes are executed, operation on the current MID input will be repeatedly performed at steps 11-6 to 11-9 until it is judged at step 11-9 that all of the data have been transferred, and the operation returns from step 11-9 to step 11-1.

In the play mode, it is judged at step 11-10 whether or not the interval time previously transferred has lapsed. When YES, operation goes to step 11-11, where the request signal RQ 3 is made active, and MIDI data is sent from the buffer 400 to the bus 10 at step 11-12. Receiving the acknowledge signal ACK 3 from the DMAC 100, the MIDI input/output device 303 retrieves data at step 11-3, and executes parallel/serial conversion on the retrieved data to output the same. Since MIDI data is of several bytes, processes of steps 11-11 to 11-13 are repeatedly executed for several times corresponding to the number of the bytes. When it is judged at step 11-13 that all of the MIDI data have been output, the MIDI input/output device 303 sets interval data for designating timing of MIDI output to an internal time counter at step 11-14, and returns to step 11-1.

The MIDI input/output device 303 set to the play mode operates at steps 8-7 to 8-11 of FIG. 8 for musical piece reproducing operation of the CPU 121.

<Operation of DMAC 100>

The operation of the DMAC 100 will be described with reference to FIG. 12. The flowchart of FIG. 12 may illustrate that the service controller 108 of FIG. 3 operates under control of the microprogram control, or that the DMAC 100 realizes its function by a hardware logic.

It is judged at step 12-1 whether a selecting signal (not shown in FIG. 2) has been supplied from the CPU 121. When YES, it is judged at step 12-2 which signal, a read signal RD or a write signal WR, is designated by the CPU 121. When the read signal RD is designated, the operation goes to step 12-3, where the contents of the registers 104, 105, which are designated by the address signals supplied via the bus 10 are output via the bus 10, so that the CPU 121 can read them. When the write signal WR is designated, the operation goes to step 12-4, where the desired data will be set to the designated registers 104, 105 via the bus 10. The process at step 12-4 corresponds to the process at step 8-7 of the main routine process of the CPU 121.

When the CPU 121 terminates the accessing to or the programming of the DMAC 100, the selecting signal is set inactive, and the operation goes from step 12-1 to step 12-5.

It is judged at step 12-5 whether the DMA transfer request signals are supplied from the respective audio input/output devices 301, 302, MIDI input/output device 303, and the HDC 201. When the request signal is sent from any of the above components, the operation goes to step 12-6, where the DMA enable signal DMAENB is set to "1" or active, so that only the DMAC 100 occupies the bus 10, disabling any access from the CPU 121.

When multiple requests are made, the DMAC 100 successively selects channels at step 12-7 in priority order of the channel, from CH 1 down to CH 4. When, for instance, requests of data transfer of the audio tracks Tr 1, Tr 2, and MIDI track are simultaneously made, the DMA transfer of the audio track Tr 1 will be executed first because the channel CH 1 is given the highest priority.

As will be understood from the later description, since the CH 4 is given the lowest priority, when a data transfer request is made from any of the input/output devices 301, 302, 303 while the data transfer is on between the hard disk 200 and any area of the buffers 400, the data transfer to the input/output devices will be carried on prior to other data transfer.

Then, the DMAC 100 outputs at step 12-8 the current address (the content of the current address register of the relevant channel of the address register 104) of the selected channel to the bus 10. Referring to the content of the control register 105 of the selected channel, the DMAC 100 decides at step 12-9 which direction the DMA transfer is to be effected. When the DMAC 100 decides to transfer data from a particular area of the buffer 400 to the other components (input/output devices), the operation goes from step 12-10 to step 12-11, where the DMAC 100 supplies the read signal RD to the buffer 400. When the DMAC 100 decides to transfer data from other components (input/output devices) to the buffer 400 to, the operation goes to step 12-12, where the DMAC 100 supplies the write signal WR to the relevant area of the buffer 400.

At step 12-13 the acknowledge signal ACK is made active. As a result, data transfer is executed between the buffer 400 and the respective tracks Tr. At step 12-14, since one data transfer has been finished, the read signal RD or the write signal WR, and the acknowledge signal ACK are made inactive. At step 12-15, the DMAC 100 increments the content of the current address (in the address register 104 of FIG. 3) of the relevant channel by one. The content of the current address (in the address register 104) of the channel is to be increased through the process at step 12-15 every time new audio data and MIDI data are written into or read out from the buffer 400. The operation returns from step 12-15 to step 12-1.

After the data transfer has been finished, the operation advances from step 12-5 to step 12-16, where the DMAC 100 sets the DMA enabling signal DMAENB inactive. Then, the DMAC 100 is prohibited from occupying the bus 10, allowing the CPU 121 to access the respective components of FIG. 2.

The DMAC 100 executes data transfer between the hard disk 200 and the buffer 400, using the address register 104 and the control register 105 in the channel CH4. This operation will be carried out after the CPU 121 performs the interrupt routine operation of FIG. 9, setting and controlling the DMAC 100 and the HDC 201.

The CPU 121 sets and controls the DMAC 100 at steps 9-1 to 9-4 of FIG. 9 while the DMAC 100 performs the processes at steps 12-3 and 12-4 in response to the above operation of the CPU 121. More specifically, the CPU 121 decides a track to which data is to be transferred through the channel CH 4, and sets the start address of the buffer corresponding to the track decided above to the start address register (the address register 104 of FIG. 3) of CH 4. The CPU 121 calculates the number of data to be transferred in the track this time from the difference between the start address and the current address (the address incremented after the previous data transfer is executed between the buffer 400 and the hard disk 200), and copies the current address of this track to the start address.

The CPU 121 programs the HDC 201 at steps 9-5, 9-6, and then allows the HDC 201 to actually issue a data transfer request for starting the DMA transfer.

Detecting the data transfer request made by the HDC 201 at step 12-5, the DMAC 100 performs the processes at steps 12-6 to 12-9 as done above, and then goes to step 12-10, where it is judged whether the data transfer from the buffer 400 to the hard disk 200 is requested or the data transfer in the opposite direction is requested. When the former data transfer is requested, the operation goes to step 12-11. When the latter data transfer is requested, the operation goes to step 12-12, and then the processes at steps 12-13 to 12-15 are executed. Since, in this case, digital audio data in one sampling or MIDI data in one unit is transferred in a single transfer operation, the block transfer will be executed by repeatedly executing the processes at steps 12-5 to 12-15 for several times.

When the DMA transfer has been completed, the transfer request RQ will not be sent forth, and the operation advances from step 12-5 to step 12-16, where the DMAC 1000 sets the DMA enabling signal DMAENB inactive.

As described above, the DMAC 100 will successively execute data transfer for respective tracks between the hard disk 200 and the area of the buffer 400 corresponding to the track in operation, and thus data transfer is executed following to the last data transfer (block transfer). Of course, when an event to be reproduced is changed, the event will be changed in accordance with the previously determined order in the manner described with reference to FIG. 6.

Figure 16:
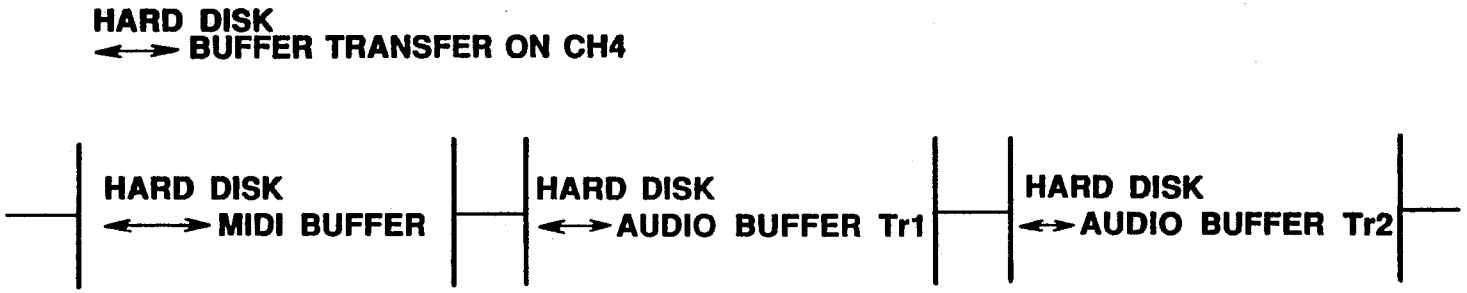
FIG. 16 is a timing chart illustrating a state of data exchange between buffers and a hard disk of FIG. 2.

FIG. 16 is a view illustrating how the DMAC 100 successively executes data transfer from the hard disk 200 to the MIDI buffer, the audio buffers Tr 1 and Tr 2 in the buffer 400.

<Operation of HDC 201>

Figure 13:
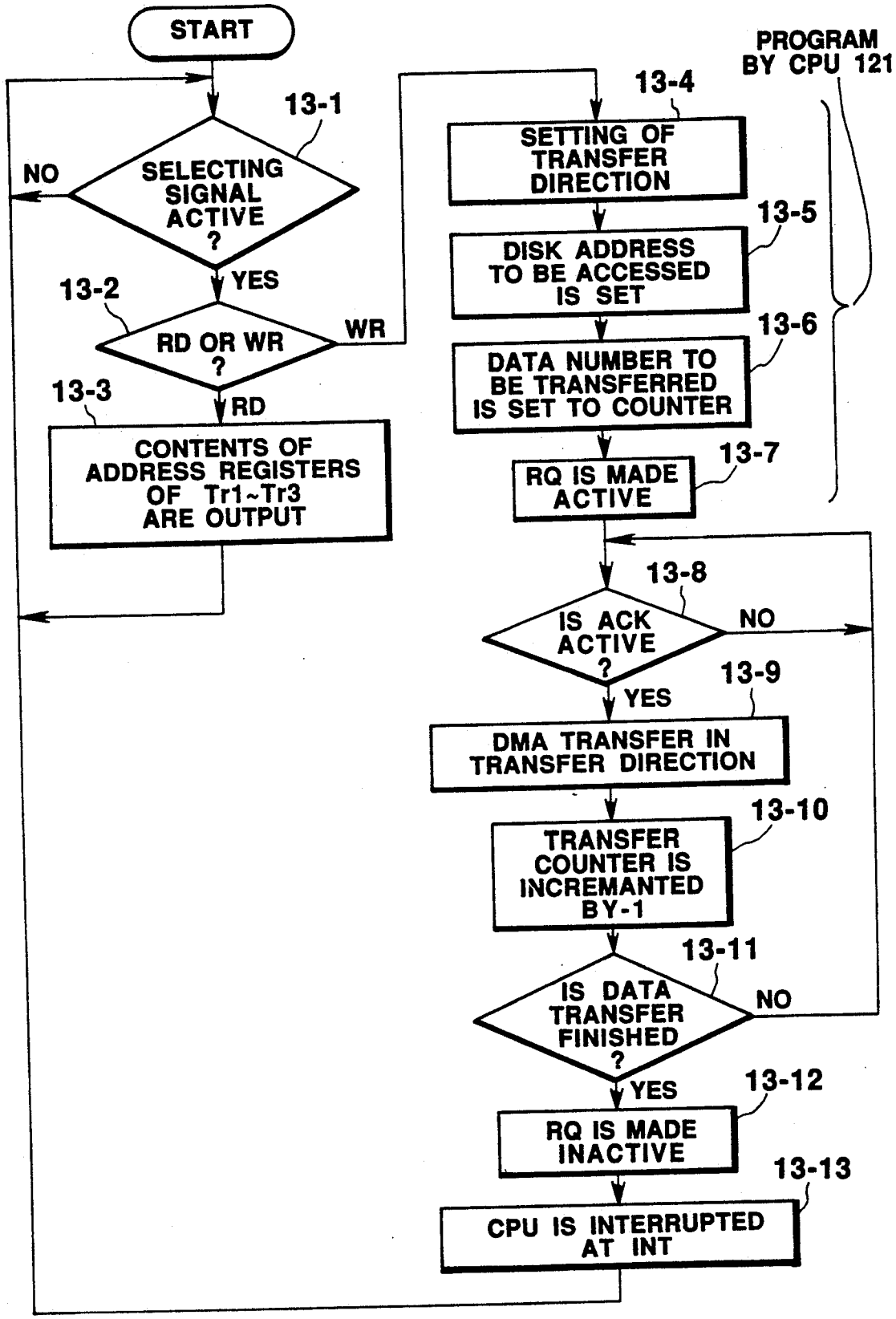
FIG. 13 is a flow chart of operation of HDC of FIG. 2.

The operation of the HDC 201 will now be explained referring to FIG. 13. The HDC 201 may be operated by either a hardware logic or microprogram control; in either case, the operational flow in FIG. 13 can be accomplished.

First, it is judged at step 13-1 whether or not the selecting signal (not shown in FIG. 2) has been given from the CPU 121; this selecting signal is applied in the interrupt routine of the CPU 121 (at steps 9-5, 9-6 of FIG. 9). If the result of the judgement is negative (NO), the operation returns to step 13-1 again, but if the result of the judgement is affirmative (YES), the operation goes to step 13-2. At this step 13-2, it is judged whether the read signal RD or the write signal WD is sent from the CPU 121. If the read signal RD is supplied, the designated data in the HDC 201 (the content of the address register or the like) is sent through the bus 10 to the CPU 121 at step 13-3.

If the write signal WR has been supplied from the CPU 121, the operation advances from step 13-2 to step 13-4, where the direction of DMA transfer between the buffer 400 and the hard disk 200 is set. At the next step 13-5, the access point of the hard disk 200 to be accessed is set by the access pointer for the track which the CPU 121 has obtained from the work RAM 122 at step 9-5 of FIG. 9.

At the subsequent step 13-6, the number of data to be transferred (the number of digital audio data/MIDI data) is set to the internal counter of the HDC 201. This number of data is obtained in the interrupt routine process of the CPU 121 at step 9-6 of FIG. 9.

In the processes at steps 13-4 to 13-6, the HDC 201 is programmed under control of CPU 121. Then, the HDC 201 requests the DMAC 100 for data transfer at step 13-7. It will be understood from the above that upon receipt of an interrupt signal INT from the HDC 201, CPU 121 executes the setting and controlling of the DMA 100 for the DMA transfer in association with the next track (in the order of the audio tracks Tr 1, Tr 2, MIDI Track, the audio tracks Tr 1, Tr 2 . . . ). Then, CPU 121 leaves from the HDC 201 and DMAC 100, permitting these controllers to perform the DMA transfer through the mutual interaction.

Figure 12:
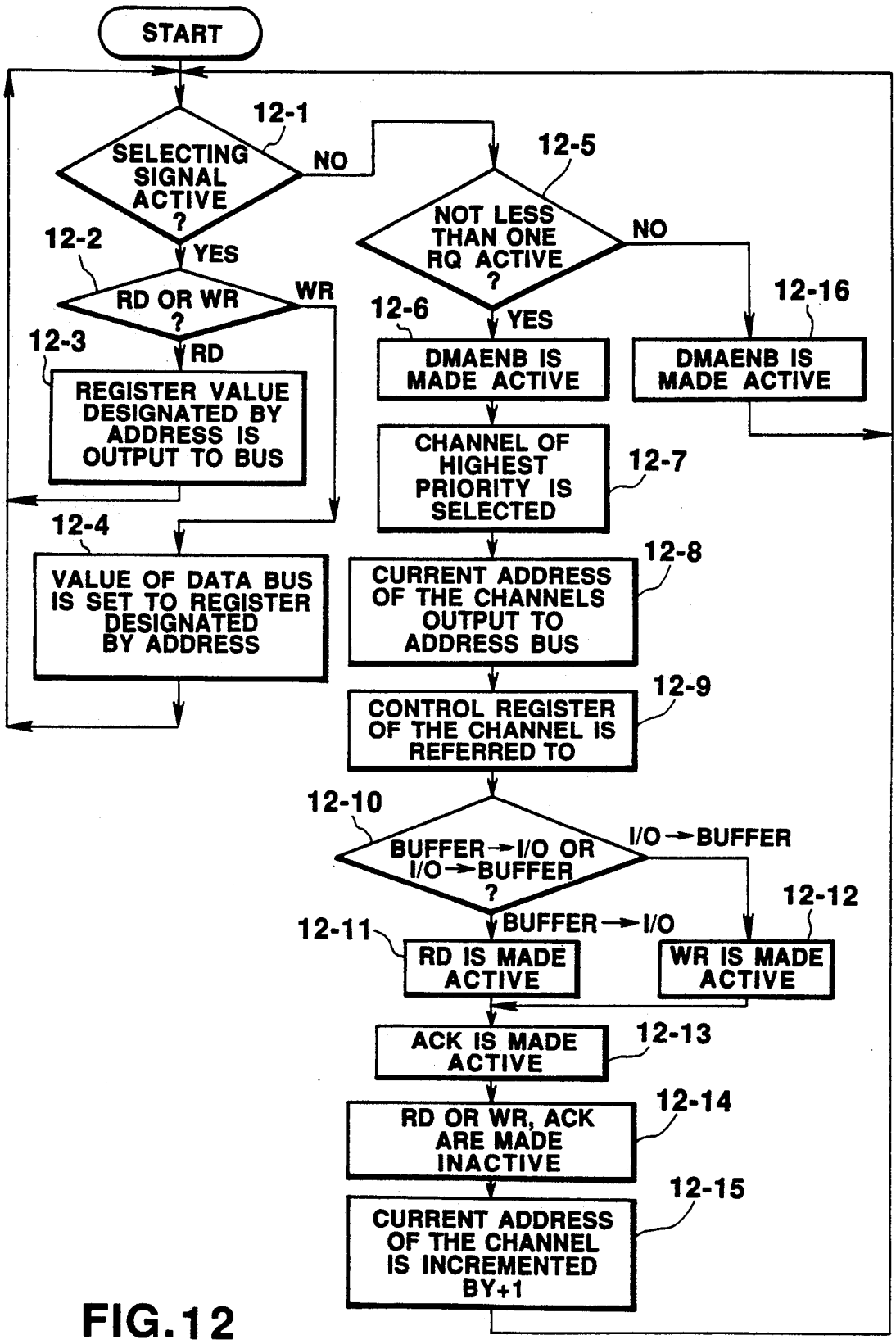
FIG. 12 is a flow chart of operation of DMAC of FIG. 2.

The HDC 201 moves from step 13-7 to step 13-8, where the HDC 201 repeatedly executes the process of step 13-8 until it receives the acknowledge signal ACK 4 from the DMAC 100 (see step 12-13 of FIG. 12).

When the judgment at step 13-8 is affirmative (YES), the operation advances to step 13-9, where digital audio data in one sampling or MIDI data in single unit is transferred through the operation of the DMAC 100, and the transfer counter which has been set at step 13-6 is decremented by "1" at step 13-10. Depending on the content of the transfer counter, it is judged at step 13-11 whether a preset number of data to be transferred has been transferred. When the judgment is negative (NO), the operation returns to step 13-8, again. The DMAC 100 therefore receives repeatedly the transfer requests RQ 4 until the data (block transfer) of the number previously set by HDC 201 has been completely transferred. In response to the transfer requests, the DMAC 100 executes the processes at steps 12-5 to 12-15 of FIG. 12 while HDC 201 performs the processes at steps 13-8 to 13-11.

When it is judged at step 13-11 that the data transfer has been completed, the operation moves to step 13-12, Where the data transfer request signal RQ 4 from the HDC 201 to the DMAC 100 is made inactive. The HDC 201 sends the interrupt signal INT to CPU 121 at step 13-13 to allow data transfer to be executed for the next track between the hard disk 200 and one of the track area of the next priority in the buffer 400. In response to this interrupt signal INT, CPU 121 performs the interrupt routine operation of FIG. 9 as described above.

<Modified Embodiment>

One embodiment of the present invention has been described in detail, but the scope of the invention is not limited to the embodiment.

That is, in the above embodiment, two sorts of data as audio data and MIDI data are combined as musical piece data in accordance with the musical piece schedule table and the musical piece data is transmitted from the music supplier to the automatic playing apparatus 12. The automatic playing apparatus 12 is arranged to store the musical piece data in the hard disk 200, and to reproduce the musical piece data at an instruction of the user. A combination of data other than the above two sorts of data, such as sequence data to be used for determining other functions and processes, data of musical score, words and other various image data may be used for recording/reproducing operation.

As described above in detail, the apparatus according to the present invention allows the user to combine reproducing operation of audio data and playing operation depending on a sequencer, in various manner during the performance of a musical piece.

The automatic playing apparatus of the present invention is arranged to receive data from the outside, which data is complex combination of audio data and sequence data for reproduction, so that the user can enjoy a wide variety of performances.

Several embodiments of the present invention have been described in detail but these embodiments are simply illustrative and not restrictive. The present invention may be modified in various manners. All the modifications and applications of the present invention will be within the scope and spirit of the invention, so that the scope of the present invention should be determined only by what is recited in the present appended claims and their equivalents.

What is claimed is:

1. An automatic playing apparatus comprising:
audio data storing means for storing audio data;
sequence data storing means for storing sequence data;
schedule table storing means for storing a schedule table which defines a schedule for reproduction of the audio data stored in said audio data storing means and the sequence data stored in said sequence data storing means;
reading means for reading out the audio data from said audio data storing means and the sequence data from said sequence data storing means in accordance with the schedule table stored in said schedule table storing means;
converting means for converting the audio data read out by said reading means into an audio signal; and
musical tone generating means for generating corresponding musical tones in accordance with the sequence data read out by said reading means.

2. An automatic playing apparatus according to claim 1, wherein the audio data stored in said audio data storing means is divided into a plurality of events, and the schedule table defines an order of reproduction of the plurality of events.

3. An automatic playing apparatus according to claim 1, wherein the sequence data stored in said sequence data storing means is divided into a plurality of events, and the schedule table defines an order of reproduction of the plurality of events.

4. An automatic playing apparatus comprising:
receiving means for receiving audio data concerning a music piece, sequence data and schedule data which defines a schedule of reproduction of the audio data and the sequence data, the audio data, the sequence data and the schedule data being transferred to the receiving means;
audio data storing means for storing the audio data received by said receiving means;
sequence data storing means for storing the sequence data received by said receiving means;
schedule table storing means for storing the schedule table received by said receiving means;
reading means for reading out the audio data from said audio data storing means and the sequence data from said sequence data storing means in accordance with the schedule table stored in said schedule table storing means;
converting means for converting the audio data read out by said reading means into an audio signal; and
musical tone generating means for generating corresponding musical tones in accordance with the sequence data read out by said reading means.

5. An automatic playing apparatus according to claim 4, wherein the audio data stored in said audio data storing means is divided into a plurality of events, and the schedule table defines order of reproduction of the plurality of events.

6. An automatic playing apparatus according to claim 4, wherein the sequence data stored in said sequence data storing means is divided into a plurality of events, and the schedule table defines an order of reproduction of the plurality of events.

7. An automatic playing apparatus comprising:
external memory means of a random access type for storing audio data and sequence data;
schedule table storing means for storing a schedule table which defines a schedule for reproduction of the audio data and the sequence data stored in said external memory means;
first buffer means for receiving the audio data from said external memory means and temporarily storing the received audio data;
audio output means for reproducing an audio signal based on the audio data, when the audio data stored in said first buffer means is supplied thereto;
second buffer means for receiving the sequence data from said external memory means and temporarily storing the received sequence data;
musical-tone generating means for generating musical tones based on the sequence data, when the sequence data stored in said second buffer means is supplied thereto;
data transfer means for selectively executing, in predetermined order of priority, data transfer between said audio output means and said first buffer means, data transfer between said musical-tone generating means and said second buffer means, data transfer between said external memory means and said first buffer means and data transfer between said external memory means and the second buffer means; and
control means for controlling said data transfer means so as to transfer the audio data from said external memory means to said first buffer means and to transfer the sequence data from said external memory means to said second buffer means, in accordance with the schedule table stored in said schedule table storing means.

8. An automatic playing apparatus according to claim 7, wherein the audio data stored in said external storing means is divided into a plurality of events, and the schedule table defines an order of reproduction of the plurality of events.

9. An automatic playing apparatus according to claim 7, wherein the sequence data stored in said external storing means is divided into a plurality of events, and the schedule table defines an order of reproduction of the plurality of events.

* * * * *